US009467787B2

(12) United States Patent
Lim et al.

(10) Patent No.: US 9,467,787 B2
(45) Date of Patent: Oct. 11, 2016

(54) HEARING AID WITH A REPLACEABLE INSERTION CAP

(75) Inventors: Yew Yee Marcus Lim, Singapore (SG); Kok Hong Ng, Singapore (SG); Wen Chong Lex Tan, Singapore (SG)

(73) Assignee: Sivantos Pte. Ltd., Singapore (SG)

( * ) Notice: Subject to any disclaimer, the term of this patent is extended or adjusted under 35 U.S.C. 154(b) by 1056 days.

(21) Appl. No.: 13/378,747

(22) PCT Filed: Jun. 16, 2009
(Under 37 CFR 1.47)

(86) PCT No.: PCT/SG2009/000214
§ 371 (c)(1),
(2), (4) Date: Mar. 6, 2012

(87) PCT Pub. No.: WO2010/147554
PCT Pub. Date: Dec. 23, 2010

(65) Prior Publication Data
US 2012/0243717 A1 Sep. 27, 2012

(51) Int. Cl.
*H04R 25/00* (2006.01)

(52) U.S. Cl.
CPC ..... *H04R 25/604* (2013.01); *H04R 25/656* (2013.01); *H04R 25/652* (2013.01); *H04R 25/654* (2013.01); *H04R 25/658* (2013.01)

(58) Field of Classification Search
CPC H04R 1/1016; H04R 25/652; H04R 25/604; H04R 25/658
USPC ..... 381/380, 375, 325, 328, 323, 324; 181/135; 128/864
See application file for complete search history.

(56) References Cited

U.S. PATENT DOCUMENTS

| | | | | |
|---|---|---|---|---|
| 4,447,667 | A * | 5/1984 | Parker | A62D 3/34 208/262.1 |
| 5,193,116 | A * | 3/1993 | Mostardo | 381/324 |
| 5,631,965 | A | 5/1997 | Chang et al. | |
| 5,875,254 | A | 2/1999 | Hanright | |
| 5,881,159 | A | 3/1999 | Aceti et al. | |
| 5,887,070 | A * | 3/1999 | Iseberg | H04R 1/1016 181/130 |
| 7,113,611 | B2 | 9/2006 | Leedom et al. | |
| 8,180,094 | B2 * | 5/2012 | Harvey | 381/380 |
| 8,270,648 | B2 * | 9/2012 | Murozaki | 381/328 |
| 8,270,656 | B2 * | 9/2012 | Stiehl et al. | 381/380 |
| 8,280,093 | B2 * | 10/2012 | Siahaan et al. | 381/380 |
| 8,320,601 | B2 * | 11/2012 | Takigawa et al. | 381/380 |
| 8,348,010 | B2 * | 1/2013 | Stiehl et al. | 181/130 |
| 8,391,536 | B2 * | 3/2013 | Hashimoto | 381/380 |
| 8,590,665 | B2 * | 11/2013 | Stiehl et al. | 181/130 |

(Continued)

FOREIGN PATENT DOCUMENTS

| | | |
|---|---|---|
| DE | 298 12 022 U1 | 9/1998 |
| DE | 29812022 U1 | 9/1998 |

(Continued)

*Primary Examiner* — Davetta W Goins
*Assistant Examiner* — Phylesha Dabney
(74) *Attorney, Agent, or Firm* — Laurence A. Greenberg; Werner H. Stemer; Ralph E. Locher

(57) ABSTRACT

A hearing aid has a coupling structure, a first hearing aid housing portion and a second hearing aid housing portion including a flexible material so that the second hearing aid housing portion is adaptable to different ear canal size. The second hearing aid housing portion is detachably coupled to the first hearing aid housing portion via the coupling structure.

15 Claims, 4 Drawing Sheets

(56) References Cited

U.S. PATENT DOCUMENTS

| | | | | |
|---|---|---|---|---|
| 2002/0027996 | A1 | 3/2002 | Leedom et al. | |
| 2005/0286731 | A1 | 12/2005 | Shennib et al. | |
| 2007/0183612 | A1 | 8/2007 | Ochsenbein et al. | |
| 2007/0206826 | A1 | 9/2007 | Rohrlein | |
| 2008/0285783 | A1 | 11/2008 | Gebert et al. | |
| 2009/0304216 | A1 | 12/2009 | Hansen | |
| 2011/0182457 | A1* | 7/2011 | Tung | H04R 1/1041 381/380 |
| 2013/0051592 | A1* | 2/2013 | Campbell et al. | 381/328 |
| 2013/0148830 | A1* | 6/2013 | Sakaguchi et al. | 381/312 |

FOREIGN PATENT DOCUMENTS

| | | | |
|---|---|---|---|
| JP | S56056320 | U | 5/1981 |
| JP | 10276499 | A | 10/1998 |
| JP | 2000506697 | A | 5/2000 |
| JP | 2001512943 | A | 8/2001 |
| JP | 2002531035 | A | 9/2002 |
| JP | 2007228580 | A | 9/2007 |
| WO | 9400089 | A1 | 1/1994 |
| WO | 9907182 | A2 | 2/1999 |
| WO | 2008095505 | A1 | 8/2008 |

* cited by examiner

HEARING AID WITH A REPLACEABLE INSERTION CAP

BACKGROUND OF THE INVENTION

Field of the Invention

Embodiments relate to a hearing aid with a replaceable insertion cap.

A hearing aid is usually fitted in or behind the ear of the user to amplify the sound for the user. Some popular types of hearing aids include behind-the-ear (BTE) hearing aids, in-the-ear (ITE) hearing aids, in-the-canal (ITC) hearing aids, completely-in-the-canal (CIC) hearing aids, etc.

A hearing aid usually includes a hearing aid housing within which a microphone for collecting sound waves, an amplifier for amplifying the collected sound waves and a loudspeaker (which may also be referred to as a receiver in the field of hearing aids) may be housed. To provide power for the microphone, the amplifier and the loudspeaker, the hearing aid usually includes a battery chamber housing positioned within the hearing aid housing and configured to receive a battery. The hearing aid may also include a battery chamber housing locking mechanism or a battery door disposed over the battery chamber housing and configured to allow or prevent access to the battery.

BRIEF SUMMARY OF THE INVENTION

In various embodiments, a hearing aid may be provided, which may include a replaceable insertion cap which provide a customized fitting and improve the hygiene standard while minimizing an increase of cost of the hearing aid.

In various embodiments, a hearing aid may be provided, which may take into account that the ear of every hearing aid user is unique, and may provide a customised fitting to avoid issues like feedback, incorrect canal fitting, for example.

In various embodiments, a hearing aid may be provided, which may take into account that, depending on the location of each hearing aid relative to the ear, there may be an accumulation of ear wax on the hearing aid, which may render the hearing aid unhygienic over a period of time. In various embodiments, a hearing aid may be provided, which may provide for a replacement of the hearing aid when this happens so as to maintain the hygiene standard.

An embodiment relates to a hearing aid. The hearing aid may include a coupling structure, a first hearing aid housing portion and a second hearing aid housing portion including a flexible material so that the second hearing aid housing portion is adaptable to different ear canal size. The second hearing aid housing portion may be detachably coupled to the first hearing aid housing portion via the coupling structure. The first hearing aid housing portion and the second hearing aid housing portion may be two separate components, brought together by the coupling structure.

In an embodiment, the first hearing aid housing portion may be termed a "shell".

In an embodiment, the first hearing aid housing portion may include a receiver holder configured to receive a receiver. The receiver holder may be made of a same or a different material from the first hearing aid housing portion. The receiver holder may include a dimension slightly larger than the dimension of the receiver so as to accommodate the receiver. The receiver holder may be rectangular in shape or may include a shape corresponding to the shape of the receiver. The receiver holder may include any other shapes or of any suitable dimensions depending on user and design requirements.

In an embodiment, the receiver holder may include an interior portion and an exterior portion. The second hearing aid housing portion may also include an interior portion and an exterior portion.

In an embodiment, the coupling structure may be disposed on at least one side of the exterior portion of the receiver holder. By way of example, the coupling structure may be disposed on two opposite sides of the exterior portion of the receiver holder. The coupling structure on the two opposite sides may be aligned along a same or different axis.

In an embodiment, the coupling structure may include a stud, a hook, a plurality of screw threads, a protruding rim or a screw. By way of example, the coupling structure may include two studs or hooks such that each stud or hook may be positioned on one side of the exterior portion of the receiver holder and the second hearing aid housing portion may include two catches such that each catch may be positioned on one side of an interior portion of the second hearing aid housing portion such that the second hearing aid housing portion may be detachably coupled to the receiver holder via the studs or hooks and the catches. Further, the coupling structure may include a plurality of screw threads such that the plurality of screws are positioned along a substantial length of the exterior portion of the receiver holder and the second hearing aid housing portion may include a corresponding plurality of screw threads such that the corresponding plurality of screw threads are positioned on an interior portion of the second hearing aid housing portion such that the second hearing aid housing portion may be detachably coupled to the receiver holder via the plurality of screw threads and the corresponding plurality of screw threads. The coupling structure may include a protruding rim surrounding the exterior portion of the receiver holder. The second hearing aid housing portion may include a corresponding groove or recess positioned on the interior portion of the second hearing aid housing portion. The groove or recess may be configured so as to engage the protruding rim such that the second hearing aid housing portion may be detachably coupled to the receiver holder. In addition, the coupling structure may include a screw, which may extend from the second hearing aid housing portion through to the first hearing aid housing portion or from the first hearing aid housing portion to the second hearing aid housing portion. The coupling structure may include any other mechanism depending on user and design requirements.

In an embodiment, the receiver holder may further include at least one recess portion disposed on at least one side of the interior portion of the receiver holder. By way of example, the receiver holder may further include two recess portions disposed on opposite sides of the interior portion of the receiver holder. The two recess portions on the opposite sides may be aligned along a same or different axis. Further, each of the two recess portions may be a blind hole and have a depth less than the thickness of each side of the receiver holder. Alternatively, each of the two recess portions may be a through hole formed through each corresponding side of the receiver holder.

In an embodiment, the hearing aid may further include a receiver. The receiver may be rectangular in shape.

In an embodiment, the hearing aid may further include at least one protruding portion disposed on at least one side of the receiver, the at least one protruding portion may be configured to be received in the at least one recess portion to secure the receiver within the receiver holder. There may be two protruding portions, each protruding portion disposed on two opposites of the receiver. Each of the two protruding portions may be a stud.

In an embodiment, each recess portion on the receiver holder may have a shape corresponding to the shape of each protruding portion on the receiver. Each corresponding recess portion may have a dimension slightly larger than the dimension of each corresponding protruding portion so that each corresponding protruding portion may be accommodated in each corresponding recess portion. The number and dimensions of protruding portions and recess portions may vary depending on user and design requirements.

In an embodiment, the hearing aid may further include a microphone.

In an embodiment, the hearing aid may further include a battery chamber housing configured to receive a battery.

In an embodiment, the hearing aid may further include an amplifier.

In an embodiment, the receiver may be positioned in the receiver holder. The microphone, the battery chamber housing and the amplifier may be positioned in the first hearing aid housing portion.

In an embodiment, the receiver holder may further include at least one contact portion positioned at a base on the interior portion of the receiver holder so as to allow communication between the amplifier and the receiver. The receiver holder may include two contact portions positioned at the base of the interior portion of the receiver holder. The number and position of the contact portions may vary depending on user and design requirements.

In an embodiment, the receiver holder may further include an opening so as to allow insertion of the receiver into the receiver holder. The dimension of the opening may be slightly larger than at least one side of the receiver to be inserted.

In an embodiment, the first hearing aid housing portion may include a rigid material. The first hearing aid housing portion may include a plastic material or any other suitable materials so as to act as a covering for the components housed within the first hearing aid housing portion.

In an embodiment, the second hearing aid housing portion may include a permeable membrane configured to allow transmission of sound waves from the receiver into an ear and to prevent ear wax from contacting the receiver. The permeable membrane may be termed a "wax guard". The permeable membrane may include a material with a plurality of holes sized so as to allow transmission of sound waves from the receiver into the ear and to prevent ear wax from contacting the receiver. The second hearing aid housing portion may also include a wire mesh design or any other suitable wax guard systems.

In an embodiment, the permeable membrane may be positioned in contact with the receiver holder and along a same axis as the receiver holder. The permeable membrane may be positioned in contact with the opening of the receiver holder.

In an embodiment, the first hearing aid housing portion may be made of a different material from the second hearing aid housing portion. The second hearing aid housing portion may include a soft rubber material which allows the second hearing aid housing portion to be adaptable to different ear canal sizes as well as to be coupled onto the first hearing aid housing portion.

In an embodiment, the hearing aid may be an in-the-ear (ITE) hearing aid, an in-the-canal (ITC) hearing aid or a completely-in-canal (CIC) hearing aid.

In the drawings, like reference characters generally refer to the same parts throughout the different views. The drawings are not necessarily to scale, emphasis instead generally being placed upon illustrating the principles of various embodiments. In the following description, various embodiments are described with reference to the following drawings, in which:

DESCRIPTION OF THE INVENTION

Figure 1:
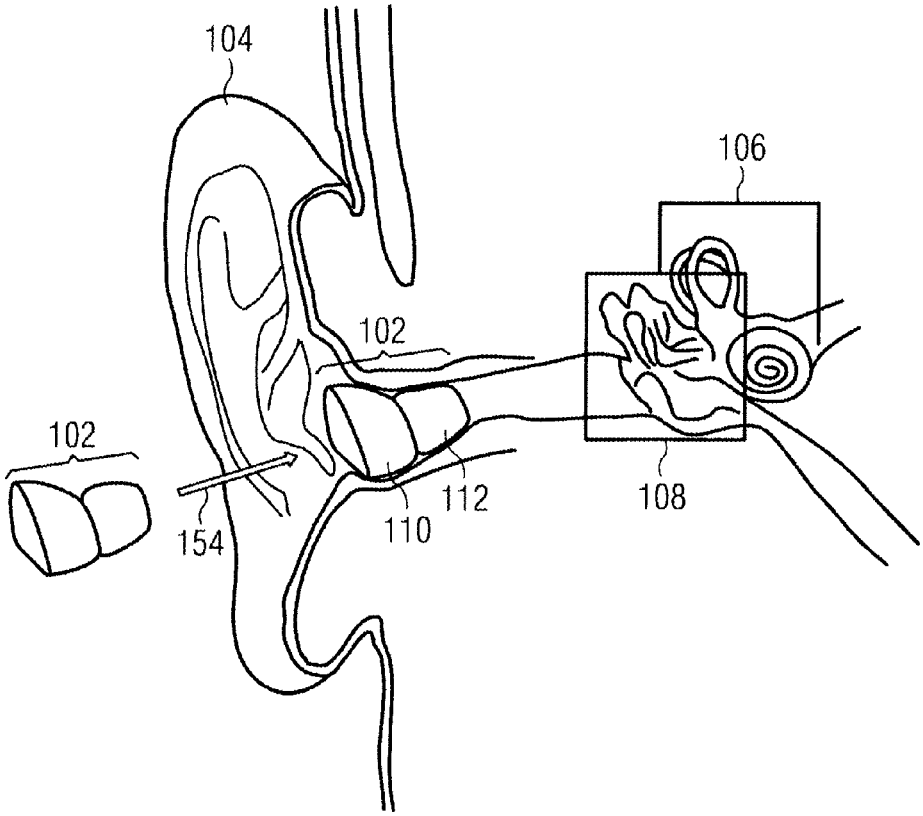
FIG. 1 shows a hearing aid positioned in an ear according to an embodiment.

FIG. 1 shows a hearing aid 102 positioned in an ear 104 according to an embodiment. By way of example, FIG. 1 shows an insertion of an in-the-ear (ITE) hearing aid 102 into the ear 104, the direction of insertion as shown by the arrow 154. FIG. 1 shows an inner ear 106 and a middle ear 108 and the relative position of the hearing aid 102 relative to the inner ear 106 and the middle ear 108 in an inserted state.

The hearing aid 102 may include a coupling structure (not shown), a first hearing aid housing portion 110 and a second hearing aid housing portion 112 including a flexible material so that the second hearing aid housing portion 112 may be adaptable to different ear canal size. The second hearing aid housing portion 112 may be detachably coupled to the first hearing aid housing portion 110 via the coupling structure.

In an embodiment, the second hearing aid housing portion 112 may be the hearing aid housing portion being inserted into the ear first, before the first hearing aid housing portion 110. In other words, in the inserted state, the second hearing aid housing portion 112 is located nearer to the inner ear 106 and the middle ear 108 than the first hearing aid housing portion 110.

Figure 2:
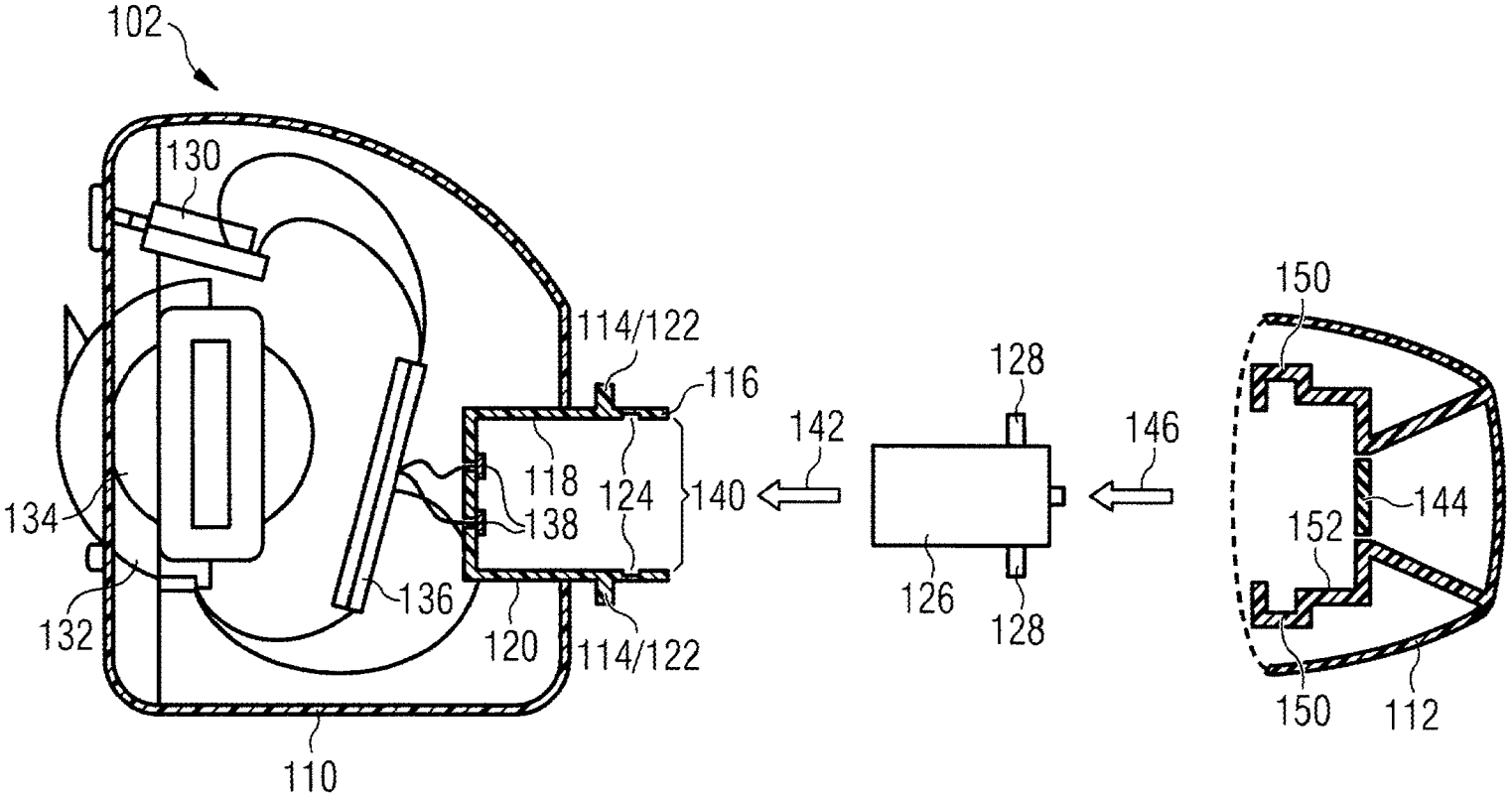
FIG. 2 shows a front view of a hearing aid with a stud coupling structure in an open position according to an embodiment.
Figure 3:
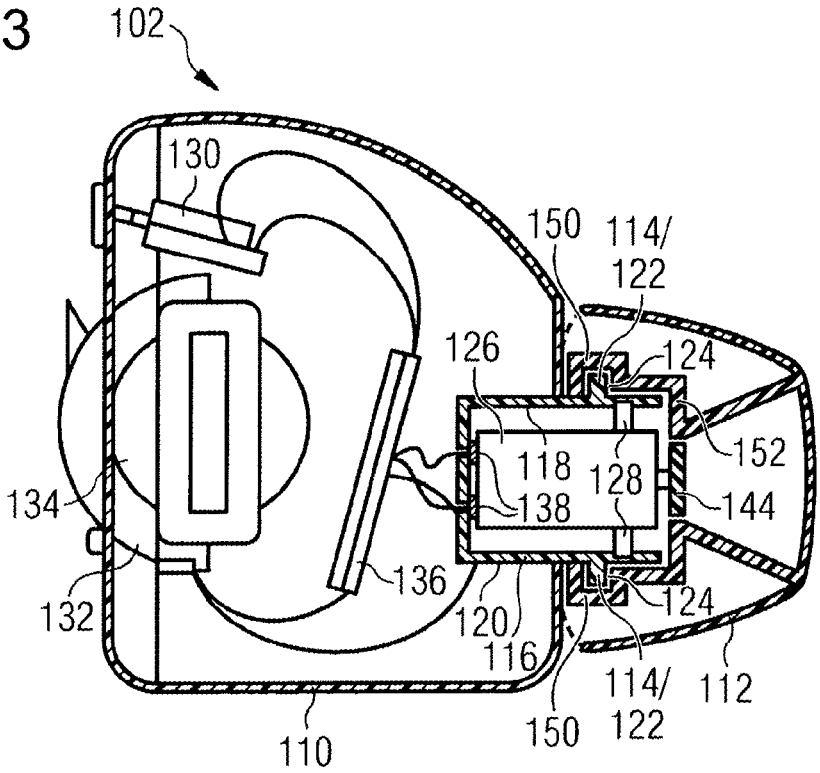
FIG. 3 shows a front view of a hearing aid with a stud coupling structure in a close position according to an embodiment.

FIG. 2 shows a front view of a hearing aid 102 with a stud coupling structure 114 in an open position according to an embodiment and FIG. 3 shows a front view of a hearing aid 102 with a stud coupling structure 114 in a closed position according to an embodiment. By way of example, FIG. 2 and FIG. 3 show an ITE hearing aid 102.

The hearing aid 102 may include a coupling structure 114, a first hearing aid housing portion 110 and a second hearing aid housing portion 112 including a flexible material so that the second hearing aid housing portion 112 may be adaptable to different ear canal size, wherein the second hearing aid housing portion 112 may be detachably coupled to the first hearing aid housing portion 110 via the coupling structure 114.

The first hearing aid housing portion 110 may include a receiver holder 116 configured to receive a receiver 126. The receiver holder 116 may include an interior portion 118 and an exterior portion 120.

The coupling structure 114 may include two studs 122 and each stud 122 may be disposed on opposite sides of the exterior portion 120 of the receiver holder 116.

The second hearing aid housing portion 112 may include two catches 150 such that each catch 150 may be positioned on opposite sides of an interior portion 152 of the second hearing aid housing portion 112 such that the second hearing aid housing portion 112 may be detachably coupled to the receiver holder 116 via the respective studs 122 and catches 150.

The receiver holder 116 may further include two recess portions 124 disposed on opposite sides of the interior portion 118 of the receiver holder 116.

The hearing aid 102 may further include a receiver 126.

The hearing aid 102 may further include two protruding portions or studs 128, each protruding portion 128 disposed on each side of the receiver 126 and each protruding portion 128 configured to be received in each recess portion 124 to secure the receiver 126 within the receiver holder 116.

The hearing aid 102 may further include a microphone 130, a battery chamber housing 132 configured to receive a battery 134 and an amplifier 136. In an embodiment, the receiver 126 may be positioned in the receiver holder 116. The microphone 130, the battery chamber housing 132 and the amplifier 136 may be positioned in the hearing aid 102, for example in the first hearing aid housing portion 110.

The receiver holder 116 may further include two contact portions 138 positioned at a base on the interior portion 118 of the receiver holder 116. The two contact portions 138 may be in contact with the respective amplifier 136 and the receiver 126. The two contact portions 138 may allow electrical current to pass through so as to allow an electrical connection between the amplifier 136 and the receiver 126.

The receiver holder 116 may further include an opening 140 so as to allow insertion of the receiver 126 into the receiver holder 116. The direction of insertion of the receiver 126 into the receiver holder 116 is as indicated by the arrow 142 as shown in FIG. 2.

The first hearing aid housing portion 110 may include a rigid material such as plastic. The first hearing aid housing portion 110 serve as a housing for the receiver 126, the microphone 130, the battery chamber housing 132 and the amplifier 136 and may be of a relatively resilient material.

The second hearing aid housing portion 112 may include a permeable membrane 144 configured to allow transmission of sound waves from the receiver 126 into an ear and to prevent ear wax from contacting the receiver 126. The permeable membrane 144 may be termed a "wax guard".

The permeable membrane 144 may be positioned in contact with the receiver holder 116 and along a same axis as the receiver holder 116 when the second hearing aid housing portion 112 is brought into contact with the receiver holder 116 as shown by the arrow 146 in FIG. 2.

The first hearing aid housing portion 110 may be made of a different material from the second hearing aid housing portion 112. The second hearing aid housing portion 112 may be made of a flexible material so as to allow the second hearing aid housing portion 112 to conform to a user's ear canal. The flexible material may include a rubber material, a sponge material, a silicon rubber material, polymer material, a rubber like material, an earplug material or any other suitable material. The material used for the second hearing aid housing portion 112 may be more flexible and adaptable than the material used for the first hearing aid housing portion 110. The material adopted for the first hearing aid housing portion 110 may render it suitable to act as a shield for the components housed therein and the material adopted for the second hearing aid housing portion 112 may render it suitable to be adaptable and disposable. The first hearing aid housing portion 110 may include a stereolithography material.

Figure 4:
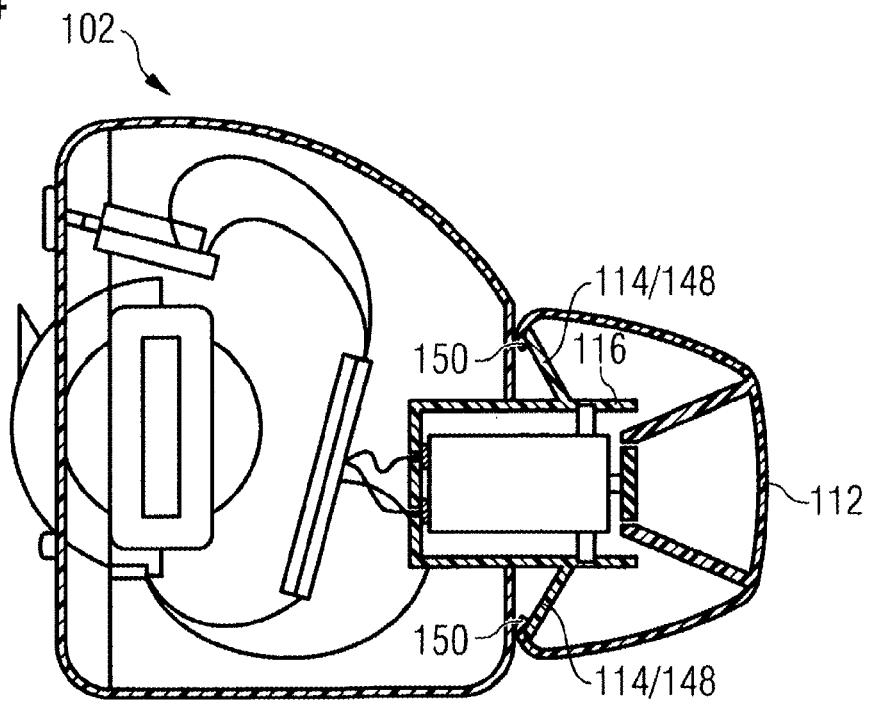
FIG. 4 shows a front view of a hearing aid with a hook coupling structure in a close position according to an embodiment.

FIG. 4 shows a front view of a hearing aid 102 with a hook coupling structure 114 in a close position according to an embodiment. The hearing aid 102 in FIG. 4 is similar to the hearing aid 102 in FIG. 3 and a difference may be seen in that the hearing aid 102 in FIG. 4 adopts two hooks 148 as the coupling structure 114 rather than two studs 122 as shown in FIG. 3. Each hook 148 may be positioned at an angle relative to the receiver holder 116 such that the catch 150 on the second hearing aid housing portion 112 may be detachably coupled onto the receiver holder 116. The two hooks 148 are disposed on opposite sides of the receiver holder 116.

Figure 5:
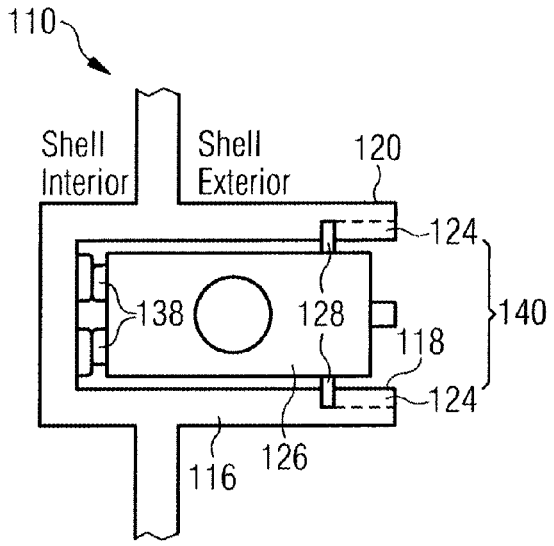
FIG. 5 shows a front view of a receiver holder according to an embodiment.
Figure 6:
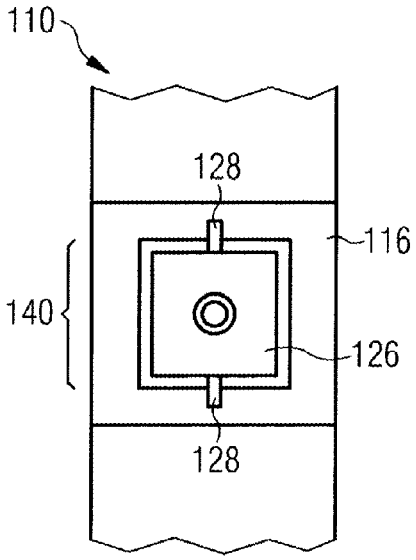
FIG. 6 shows a plan view of a receiver holder according to an embodiment.

FIG. 5 shows a front view of a receiver holder 116 according to an embodiment and FIG. 6 shows a plan view of a receiver holder 116 according to an embodiment.

The hearing aid 102 may include a first hearing aid housing portion 110 and a receiver 126. The first hearing aid housing portion 110 may include a receiver holder 116 configured to receive the receiver 126.

The receiver holder 116 may include an interior portion 118 and an exterior portion 120.

The receiver holder 116 may further include two recess portions 124, each recess position 124 disposed on opposite sides of the interior portion 118 of the receiver holder 116.

The hearing aid 102 may further include two protruding portions 128 disposed on opposite sides of the receiver 126, each protruding portion 128 configured to be received in each recess portion 124 to secure the receiver 126 within the receiver holder 116. Each of the two protruding portions 128 may include a stud made of a rubber material.

The receiver holder 116 may further include two contact portions 138 positioned at a base on the interior portion 118 of the receiver holder 116. The two contact portions 138 may be in contact with the respective amplifier (not shown) and the receiver 126. The two contact portions 138 may allow electrical current to pass through so as to allow an electrical connection between the amplifier and the receiver 126.

The receiver holder 116 further comprises an opening 140 so as to allow insertion of the receiver 126 into the receiver holder 116.

Figure 7:
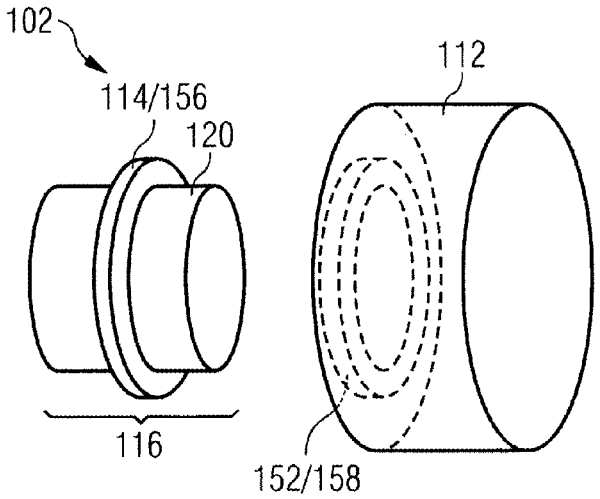
FIG. 7 shows a front view of a hearing aid with a protruding rim coupling structure in an open position according to an embodiment.

FIG. 7 shows a front view of a hearing aid 102 with a protruding rim coupling structure 114 in an open position according to an embodiment. The hearing aid 102 in FIG. 7 may be similar to the hearing aid 102 in FIG. 2 and a difference may be seen in that the hearing aid 102 in FIG. 7 may adopt a protruding rim 156 as the coupling structure 114 rather than two studs 122 as shown in FIG. 2. The protruding rim 156 may surround the exterior portion 120 of the receiver holder 116. Or the protruding rim 156 may only partially surround the exterior portion 120 of the receiver holder 116.

Further the second hearing aid housing portion 112 may include a corresponding groove or recess 158 positioned on the interior portion 152 of the second hearing aid housing portion 112. The groove or recess 158 may be configured so as to engage the protruding rim 156 such that the second hearing aid housing portion 112 may be detachably coupled to the receiver holder 116.

The protruding rim 156 and the corresponding groove or recess 158 may be circular in shape, or may be of any suitable shape corresponding to the shape of the receiver holder 116 or the second hearing aid housing portion 112.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A hearing aid, comprising:

a first hearing aid housing portion having a receiver holder configured to receive a receiver;

a second hearing aid housing portion formed of a flexible material rendering said second hearing aid housing portion adaptable to different ear canal sizes;

said receiver holder having an interior portion configured to receive the receiver within said first hearing aid housing portion, and an exterior portion;

a coupling structure formed on at least one side of said exterior portion of said receiver holder for detachably coupling said second hearing aid housing portion to said first hearing aid housing portion;

an amplifier;

said exterior portion of said receiver holder at least partially projecting from said first hearing aid housing portion to an outside of said first hearing aid housing portion;

said receiver holder having a base disposed to separate said receiver holder from an inside volume of said first hearing aid housing portion;

said receiver holder being formed with an opening that opens to an outside of said first hearing aid housing portion, enabling the receiver to be inserted in said receiver holder; and at least one contact portion positioned at a base on said interior portion of said receiver holder so as to allow communication between said amplifier and said receiver disposed in said receiver holder.

2. The hearing aid according to claim 1, wherein said coupling structure is an element selected from the group consisting of a stud, a hook, a plurality of screw threads, a protruding rim, and a screw.

3. The hearing aid according to claim 1, wherein said receiver holder is further formed with at least one recess portion disposed on at least one side of said interior portion of said receiver holder.

4. The hearing aid according to claim 3, which further comprises a receiver with at least one protruding portion on at least one side of said receiver, said at least one protruding portion being configured to be received in said at least one recess portion for securing said receiver within said receiver holder.

5. The hearing aid according to claim 1, which further comprises a receiver.

6. The hearing aid according to claim 5, wherein said second hearing aid housing portion comprises a permeable membrane configured to allow transmission of sound waves from said receiver towards an ear drum, when the hearing aid is placed in the ear canal, and to prevent ear wax from contacting said receiver.

7. The hearing aid according to claim 6, wherein said permeable membrane is positioned in contact with said receiver holder and along a common axis with said receiver holder.

8. The hearing aid according to claim 1, which further comprises a microphone.

9. The hearing aid according to claim 1, which further comprises a battery chamber housing configured to receive a battery.

10. The hearing aid according to claim 1, wherein said receiver holder is formed with an opening allowing insertion of said receiver into said receiver holder.

11. The hearing aid according to claim 1, wherein said first hearing aid housing portion is formed of a rigid material.

12. The hearing aid according to claim 1, wherein said first hearing aid housing portion is made of a different material from said second hearing aid housing portion.

13. The hearing aid according to claim 1, configured as a hearing aid selected from the group consisting of an in-the-ear hearing aid, an in-the-canal hearing aid, and a completely-in-the-canal hearing aid.

14. A hearing aid, comprising:

a first hearing aid housing portion formed as a receiver holder configured to receive a receiver, said receiver holder being formed with an opening for insertion of a receiver in the receiver holder;

a second hearing aid housing portion formed of a flexible material rendering said second hearing aid housing portion adaptable to different ear canal sizes, said second hearing aid housing portion including a permeable membrane positioned in contact with said opening in said receiver holder;

an amplifier;

a coupling structure disposed on an exterior portion of said receiver holder and detachably coupling said second hearing aid housing portion to said first hearing aid housing portion;

said exterior portion of said receiver holder at least partially projecting from said first hearing aid housing portion to an outside of said first hearing aid housing portion;

said receiver holder having a base disposed to separate said receiver holder from an inside volume of said first hearing aid housing portion; and at least one contact portion positioned at said base on an interior portion of said receiver holder so as to allow communication between said amplifier and said receiver disposed in said receiver holder.

15. The hearing aid according to claim 14, wherein said permeable membrane is configured to allow transmission of sound waves from said receiver towards an ear drum, when the hearing aid is placed in the ear canal, and to prevent ear wax from contacting said receiver, and said permeable membrane is positioned in contact with said receiver holder and along a common axis with said receiver holder.

* * * * *